United States Patent [19]

Hall

[11] 3,949,470

[45] Apr. 13, 1976

[54] SAFETY RAZOR

[76] Inventor: Charles L. Hall, 532 Serpentine Drive, Del Mar, Calif. 92014

[22] Filed: Feb. 3, 1975

[21] Appl. No.: 546,413

Related U.S. Application Data

[63] Continuation of Ser. No. 307,393, Nov. 17, 1972, abandoned.

[52] U.S. Cl. ..... 30/50

[51] Int. Cl.[2] ..... B26B 21/22

[58] Field of Search ..... 30/32, 34.2, 50, 51, 77, 30/84, 346.53, 346.57, 346.58

[56] References Cited

UNITED STATES PATENTS

| | | | |
|---|---|---|---|
| 2,062,683 | 12/1936 | Smith | 30/346.58 X |
| 2,715,267 | 8/1955 | Force | 30/50 |
| 2,804,685 | 9/1957 | Peters | 30/50 X |
| 2,817,146 | 12/1957 | Roberts | 30/77 X |
| 3,349,488 | 10/1967 | Craig | 30/346.53 X |
| 3,871,073 | 3/1975 | Nissen | 30/34.2 |

FOREIGN PATENTS OR APPLICATIONS

| | | | |
|---|---|---|---|
| 1,140,837 | 12/1962 | Germany | 30/34.2 |

*Primary Examiner*—Al Lawrence Smith
*Assistant Examiner*—Gary L. Smith
*Attorney, Agent, or Firm*—Lowhurst & Aine

[57] ABSTRACT

In a safety razor a relatively permanent portion of the razor blade holder structure has a cutting edge formed thereon disposed to track with the cutting edge of the replaceable razor blade. In this manner the second cutting edge simultaneously tracks behind the first in cutting relation to cut whiskers missed by the first cutting edge.

4 Claims, 4 Drawing Figures

SAFETY RAZOR

This is a continuation of application Ser. No. 307,393, filed Nov. 17, 1972, and now abandoned.

DESCRIPTION OF THE PRIOR ART

Heretofore, safety razors have been proposed which included a blade holder structure for holding a pair of razor blades in mutually opposed spaced relation such that the cutting edge of the second blade tracked behind the cutting edge of the first blade to cut whiskers missed by the first cutting edge. Such a safety razor is disclosed and claimed in U.S. Pat. No. 1,975,757, issued Oct. 2, 1934.

The problem with this type of a razor is that it utilizes twice as many blades as the conventional single cutting edge safety razor. Since the expensive part of shaving is not the blade holder but rather is the cost of replacement blades, it would be desirable to have a tracking dual cutting edge safety razor which used only one replaceable blade.

SUMMARY OF THE PRESENT INVENTION

The principal object of the present invention is the provision of an improved safety razor.

In one feature of the present invention, a portion of the blade holder, which is relatively permanent relative to the permanency of the replaceable razor blade, has a cutting edge formed thereon and disposed to track with the cutting edge of the replaceable razor blade to form a dual cutting edge razor using only one replaceable blade at a time.

In another feature of the present invention, that portion of the blade holder which has the cutting edge formed thereon is made of a more durable material in shaving use than that of the replaceable razor blade, whereby the cutting edge formed on the blade holder portion greatly outlasts the cutting edge on the replaceable razor blade.

In another feature of the present invention, that portion of the blade holder which has the cutting edge formed thereon is made of a material selected from the group consisting of tungsten carbide and glass.

Other features and advantages of the present invention will become apparent upon a perusal of the following specification taken in connection with the accompanying drawings wherein:

DESCRIPTION OF THE PREFERRED EMBODIMENTS

Figure 1:
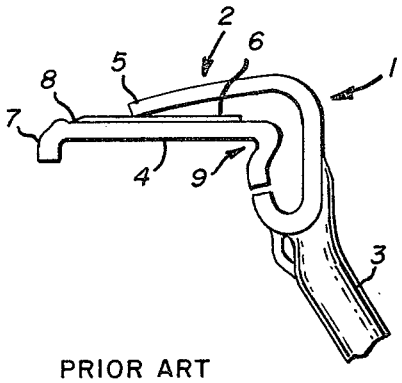
PRIOR ART Fig 1
FIG. 1 is a side elevational view of a conventional prior art injector safety razor.

Referring now to FIG. 1 there is shown the prior art injector safety razor 1. The injector safety razor 1 includes a blade holder structure 2 affixed to a handle 3 to be gripped by the person shaving.

The blade holder structure 2 includes a pair of spring loaded blade holder leaves 4 and 5 for capturing and holding a single edged injector razor blade 6 injected into the region between the two spring-biased holding leaves 4 and 5.

The lower holding leaf 4 includes a guide bar portion 7 at the free end thereof for stretching the skin and guiding the razor such that the cutting edge 8 of the razor blade 6 can cut the whiskers near the skin line. The root portion of the lower holding leaf 4 includes a convoluted portion 9 to provide the spring-bias for urging the lower leaf 4 into a pinching relation with the upper holding leaf 5.

Figure 2:
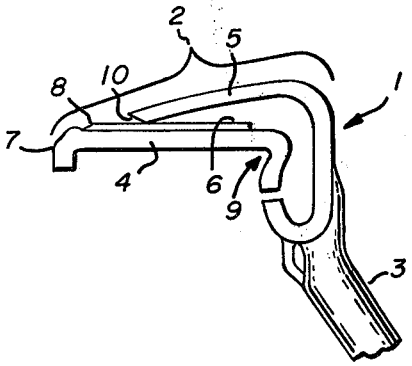
FIG. 2 is a view similar to that of FIG. 1 depicting an injector safety razor incorporating features of the present invention.

Referring now to FIG. 2, there is shown the structure of FIG. 1 modified to include a second cutting edge 10 parallel to and behind the first cutting edge 8 of the replaceable razor blade 5. The second cutting edge 10 is formed on the forward or free end of the upper holding leaf 5 such that cutting edges 8 and 10 form a dual tracking cutting edge razor such that a second one of the cutting edges simultaneously tracks behind the first in cutting relation to cut whiskers missed by the first cutting edge. The axial extent of the second cutting edge 10 is substantially coextensive with that of the first cutting edge 8.

The tip portion of the upper holding leaf 5, on which the second cutting edge 10 is formed, is preferably made of extremely durable material in shaving use. For example, in a preferred embodiment, the tip portion is made of tungsten carbide or glass. The sharpened tip portion of the upper holding leaf 5 could be made of a material different from that of the remaining portion of the leaf 5 and, in such a case, the tip portion would be bonded as by brazing, spot welding, glueing or the like to the free end of the holding leaf 5.

In an alternative embodiment, the tip portion of the holding leaf 5 on which the second cutting edge 10 is formed, is detachably secured to the holding leaf 5 as by screws to permit periodic replacement. However, the frequency of replacement would be much less than that required for replacement of the replaceable blade 6.

Thus, the second cutting edge 10 is formed on a permanent or semi-permanent portion of the blade holding structure 2, whereby only one replaceable blade is used in the razor to minimize replacement blade expense while providing the advantages of a simultaneous dual cutting edge razor.

Figure 3:
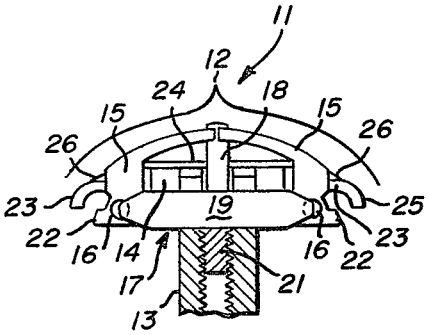
PRIOR ART Fig 3
FIG. 3 is a side elevational view of a double-edged safety razor of the prior art.

Referring now to FIG. 3 there is shown the prior art double edged safety razor 11. Razor 11 is of the conventional prior art design and includes a blade holding structure 12 with a dependent handle 13 to be gripped by the operator. The blade holding structure 12 includes a horizontal base 14 and a pair of arched cover plates 15 pivotably secured at 16 to a vertically translatable carriage 17 having a horizontal center bar 18 affixed at opposite ends to horizontal cross members 19.

An actuating screw 21 which is dependent from the center of the horizontal bar 18 threadably mates with internal threads of the handle 13 for vertical translation of the rotationally captured carriage 17 to effect opening and closing of the arched plates 15 via a caming action of dependent leg portions 22 of the arched cover plates with an inner lip 23 of the base member 14 to permit replacement of a double-edged razor blade 24 which is centrally apertured to receive the central bar 18 for centering of the blade 24 in the blade holder 12. A pair of guide bars 25 extend outwardly from opposite sides of the base plate 14 for guiding the respective cutting edges 26 of the dual edged razor 18 and for stretching the skin of the person being shaved.

Figure 4:
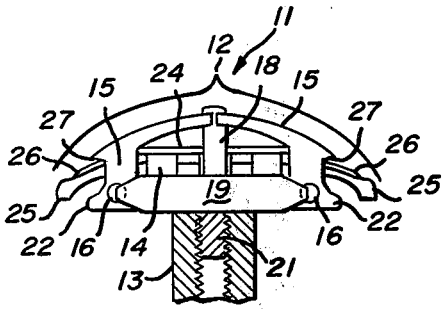
FIG. 4 is a view of the structure of FIG. 3 modified to incorporate features of the present invention.

Referring now to FIG. 4, there is shown the dual edged safety razor 11 of FIG. 3 modified to include a pair of second cutting edges 27 formed along opposite side edges of the arched cover plates 15 to define a respective pair of second cutting edges 27 for tracking behind the first cutting edges 26 on the dual edged razor blade 24 for cutting the whiskers missed by the first cutting edges 26.

As in the safety razor embodiment of FIG. 2, the second cutting edges 27 are formed on a permanent or semi-permanent portion of the blade holding structure 12 such that only one replaceable blade is employed, thereby reducing the cost of the blades in use. In a preferred embodiment, that portion of the cover plate 15 on which the second cutting edge 27 is formed is made of a durable material in shaving use. Examples of such a durable material include tungsten carbide or glass and may comprise for example only a tip portion of the plate 15 which is affixed to the plate 15 via screws, brazing, spot welding, or adhesive.

Although, thus far in the description of the present invention, the second cutting edge has been formed on the blade holding structure in such a manner as to track behind the cutting edge of the replaceable razor blade, this is not a requirement. As an alternative, the second cutting edge may be formed on a portion of the blade holder structure in such a manner that the cutting edge of the replaceable razor blade tracks behind the cutting edge formed on the blade holding structure.

What is claimed is:

1. In a safety razor:

blade holder means for holding a replaceable razor blade with the cutting edge of the blade presented for shaving whiskers, said blade holder means having a handle for gripping by the operator;

said blade holder means including a second cutting edge formed on a portion of said blade holder means, said second cutting edge being made of a more durable material in shaving use than the cutting edge of the replaceable razor blade and said second cutting edge being disposed to track with the cutting edge of the razor blade to form a dual cutting edge razor such that one of said cutting edges simultaneously tracks behind the other in cutting relation to cut whiskers missed by the other cutting edge.

2. The apparatus of claim 1 wherein said portion of said blade holder means which has said second cutting edge formed thereon is made of a material selected from the class consisting of tungsten carbide and glass.

3. The apparatus of claim 1 wherein said blade holder means is the holder of an injector razor blade and wherein said blade holder means includes, a pair of blade holding portions for capturing the razor blade therebetween, spring bias means for spring biasing said blade holding portions together for gripping and holding the razor blade captured therebetween, and wherein said second cutting edge is formed on one of said pair of said blade holding portions.

4. The apparatus of claim 1 wherein said blade holder means is the holder of a double edged razor blade, and wherein said blade holder means includes a pair of pivoted arched blade cover plates, and wherein said second cutting edge is formed on said pair of cover plates.

* * * * *